US010305188B2

(12) United States Patent
Inoue et al.

(10) Patent No.: US 10,305,188 B2
(45) Date of Patent: May 28, 2019

(54) ANTENNA DEVICE AND MANUFACTURING METHOD FOR THE SAME

(71) Applicant: SUMIDA CORPORATION, Chuo-Ku, Tokyo (JP)

(72) Inventors: Yoshinori Inoue, Natori (JP); Isao Douchi, Natori (JP); Kei Tanaka, Natori (JP); Takanari Fujimaki, Natori (JP); Yoshinori Miura, Natori (JP); Hiroshi Kawasaki, Natori (JP); Hiromitsu Kuriki, Natori (JP); Takanobu Rokuka, Natori (JP); Hiroyuki Miyazaki, Natori (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 15/672,740

(22) Filed: Aug. 9, 2017

(65) Prior Publication Data

US 2018/0159224 A1 Jun. 7, 2018

(30) Foreign Application Priority Data

Dec. 2, 2016 (JP) ..... 2016-235337

(51) Int. Cl.
*H01Q 1/22* (2006.01)
*H01Q 7/00* (2006.01)
*H01Q 7/08* (2006.01)

(52) U.S. Cl.
CPC ..... *H01Q 7/08* (2013.01); *H01Q 7/005* (2013.01); *H01Q 1/2208* (2013.01)

(58) Field of Classification Search
None
See application file for complete search history.

(56) References Cited

U.S. PATENT DOCUMENTS

2009/0278689 A1* 11/2009 Gisselberg ..... A61B 5/6883 340/572.5
2015/0116171 A1* 4/2015 Koga ..... H01Q 7/08 343/788
2015/0123761 A1* 5/2015 Winkler ..... H01F 3/08 336/221

FOREIGN PATENT DOCUMENTS

JP 2002261536 A * 9/2002 ..... H01Q 1/36
JP 2007-043588 A 2/2007

OTHER PUBLICATIONS

Extended European Search Report for EP Application No. 17184517.5, dated Feb. 13, 2018; 9 pages.

* cited by examiner

*Primary Examiner* — Howard Williams
(74) *Attorney, Agent, or Firm* — Harness, Dickey & Pierce, P.L.C.

(57) ABSTRACT

An antenna device includes: a plurality of cores arranged in series; a coil; and a capacitor connected to the coil, in which a first core, which is selected from the plurality of cores, and a second core, which is selected from the plurality of cores and is arranged on any one end portion side of the first core, are arranged apart from each other, and in which at least one end surface, which is selected from an end surface of the first core on a side on which the second core is arranged and an end surface of the second core on a side on which the first core is arranged, is located on an inner peripheral side of the coil.

20 Claims, 9 Drawing Sheets

ANTENNA DEVICE AND MANUFACTURING METHOD FOR THE SAME

CROSS-REFERENCE TO RELATED APPLICATIONS

The present application claims priority from Japanese Patent Application No. 2016-235337 filed on Dec. 2, 2016, the entirety of which is hereby incorporated by reference into this application.

BACKGROUND OF THE INVENTION

1. Field of the Invention

The present invention relates to an antenna device and a manufacturing method for the antenna device.

2. Description of the Related Art

For an antenna device, a rod-like core made of a magnetic material such as Mn—Zn ferrite is used. In order to increase an output of the antenna device, use of a rod-like core having a large length is more advantageous. However, there is a disadvantage that such a rod-like core is liable to be broken and bent when an impact or a bending stress is applied to the rod-like core.

For the purpose of solving such a problem, there has been proposed an antenna device which includes a plurality of rod-like cores arranged in series along one direction and a plurality of coils wound around the respective plurality of rod-like cores (for example, Japanese Patent Application Laid-open No. 2007-43588).

A tolerance of a resonance frequency which is required for an antenna device differs in accordance with an intended use of the antenna device. For example, in a short-distance communication system with an LF band of from 30 kHz to 300 kHz, in particular, a transmission antenna device for a passive entry/passive start (PEPS) system, a tolerance of about ±2% is required. With regard to this point, in the antenna device disclosed in Japanese Patent Application Laid-open No. 2007-43588, a small-size core, which is provided between two rod-like cores, is rotated so that the resonance frequency can be adjusted and set within a range of tolerance. However, in the antenna device disclosed in Japanese Patent Application Laid-open No. 2007-43588, in order to enable adjustment of the resonance frequency, it is necessary to additionally mount a resonance frequency adjustment mechanism such as the small-size core, and it is necessary to use a plurality of coils. As a result, a structure of the antenna device and a manufacture process are complicated.

The resonance frequency is determined based on an inductance value, which is increased or decreased in accordance with the number of windings of the coil constructing the antenna device, and a capacitance of a capacitor constructing the antenna device. In addition, commercially available capacitors used for manufacture of the antenna device have individual variation in capacitance (individual capacitance variation). Therefore, when the antenna device does not include the resonance frequency adjustment mechanism exemplified in Japanese Patent Application Laid-open No. 2007-43588, it is necessary to adjust the number of windings of a coil in accordance with a capacitance of an individual capacitor used for manufacture of the antenna device so that the resonance frequency is set within a required tolerance range.

However, for mass production of the antenna device, it is not practical to finely adjust the number of windings of the coil with a value less than one turn, which corresponds to one winding of a conductive wire constructing the coil, in accordance with a capacitance of an individual capacitor. Therefore, when the antenna device which does not include the resonance frequency adjustment mechanism is manufactured, it is necessary to classify the capacitors of the same type used for manufacture into ranks for each predetermined capacitance range and set number of windings of the coil for each capacitor in each rank in units of integer. For example, when commercially available capacitors having the individual capacitance variation of about ±5% are used to manufacture antenna devices each including one rod-like core and one coil, it is necessary to classify the capacitors into about four or five ranks in accordance with the capacitances.

When design values of the antenna device are set so that a resonance frequency is 125 kHz and so that a capacitance of the capacitor used for the antenna device is 3,300 pF, an inductance value L is 492 pH. Then, it is assumed that, when the individual capacitance variation of the capacitors is ±5%, the range of from −5% to +5% is divided into units of 2% to classify the capacitors into five ranks. In this case, for capacitors classified into the rank in which the capacitance is within the range of 3,300 pF±1%, when the number of windings of the coil can be set so as to have the inductance value L of 492 pH, an antenna device having a resonance frequency distribution with a median value of 125 kHz can be obtained.

However, as described above, at the time of manufacture of the antenna device, the number of windings of the coil is adjusted by increasing or decreasing the number of windings of the coil in units of integer. Therefore, the inductance value L changes in a stepwise manner as the number of windings increases in units of integer. For example, the inductance value L is 489 pH with the number of windings being n, is 496 pH with the number of windings being n+1, is 503 pH with the number of windings being n+2, and so on ("n" is a value larger than 0). Therefore, at the time of actual manufacture of the antenna device, the inductance value L of 489 pH, which is closest to 492 pH being an ideal value, is selected. However, deviation between the actual inductance value L selected at the time of manufacture and the ideal value implies that the median value of the resonance frequency distribution of the manufactured antenna device deviates from the design value of the resonance frequency of the antenna device. When the deviation is excessively significant, there is difficulty in setting the resonance frequency within a required tolerance range.

SUMMARY OF THE INVENTION

The present invention has been made in view of the above-mentioned circumstances, and has an object to provide an antenna device, which is capable of easily suppressing deviation between a median value of a resonance frequency distribution of a manufactured antenna device and a design value of a resonance frequency, and a manufacturing method for the antenna device.

The above-mentioned object is achieved by an embodiment of the present invention described below.

That is, according to one embodiment of the present invention, there is provided an antenna device, including at least: a plurality of rod-like cores arranged in series; a coil formed by winding a conductive wire; and a capacitor electrically connected to the coil, in which a first rod-like core, which is selected from the plurality of rod-like cores, and a second rod-like core, which is selected from the plurality of rod-like cores and is arranged on any one end portion side of the first rod-like core, are arranged apart from each other, and in which at least one end surface, which is selected from an end surface of the first rod-like core on a side on which the second rod-like core is arranged and an end surface of the second rod-like core on a side on which the first rod-like core is arranged, is located on an inner peripheral side of the coil.

In the antenna device according to one embodiment of the present invention, it is preferred that the end surface of the first rod-like core on the side on which the second rod-like core is arranged and the end surface of the second rod-like core on the side on which the first rod-like core is arranged, be located on the inner peripheral side of the coil.

In the antenna device according to another embodiment of the present invention, it is preferred that the coil be arranged in a non-symmetrical manner with respect to a region between the end surface of the first rod-like core on the side on which the second rod-like core is arranged and the end surface of the second rod-like core on the side on which the first rod-like core is arranged in an arrangement direction of the plurality of rod-like cores.

In the antenna device according to another embodiment of the present invention, it is preferred that individual capacitance variation of capacitors be ±1% or more.

In the antenna device according to another embodiment of the present invention, it is preferred that, in the arrangement direction of the plurality of rod-like cores, a distance between the end surface of the first rod-like core on the side on which the second rod-like core is arranged and the end surface of the second rod-like core on the side on which the first rod-like core is arranged be from 0.2 mm to 1.0 mm.

In the antenna device according to another embodiment of the present invention, it is preferred that a number of variations in a number of windings of the conductive wire constructing the coil be any one of one to three.

In the antenna device according to another embodiment of the present invention, it is preferred that a variation in resonance frequency of individual antenna devices be equal to or less than +2%.

According to a first aspect of the present invention, there is provided a manufacturing method for an antenna device, including at least: classifying capacitors of the same type used for manufacture of an antenna device into one of two ranks and three ranks in accordance with capacitances of individual capacitors; and forming a coil by setting a number of windings of a conductive wire to a different value in accordance with the rank of the individual capacitor and by winding the conductive wire, in which the antenna device includes at least: a plurality of rod-like cores arranged in series; the coil; and the capacitor electrically connected to the coil, in which a first rod-like core, which is selected from the plurality of rod-like cores, and a second rod-like core, which is selected from the plurality of rod-like cores and is arranged on any one end portion side of the first rod-like core, are arranged apart from each other, and in which at least one end surface, which is selected from an end surface of the first rod-like core on a side on which the second rod-like core is arranged and an end surface of the second rod-like core on a side on which the first rod-like core is arranged, is located on an inner peripheral side of the coil.

According to a second aspect of the present invention, there is provided a manufacturing method for an antenna device, including at least forming a coil by winding a conductive wire under a state in which a number of windings of the conductive wire is always set to a constant value regardless of capacitances of individual capacitors of the same type used for manufacture of the antenna device, in which the antenna device includes at least: a plurality of rod-like cores arranged in series; the coil; and the capacitor electrically connected to the coil, in which a first rod-like core, which is selected from the plurality of rod-like cores, and a second rod-like core, which is selected from the plurality of rod-like cores and is arranged on any one end portion side of the first rod-like core, are arranged apart from each other, and in which at least one end surface, which is selected from an end surface of the first rod-like core on a side on which the second rod-like core is arranged and an end surface of the second rod-like core on a side on which the first rod-like core is arranged, is located on an inner peripheral side of the coil.

According to the present invention, it is possible to provide the antenna device, which is capable of easily suppressing the deviation between the median value of the resonance frequency distribution of the manufactured antenna device and the design value of the resonance frequency, and the manufacturing method for the antenna device.

BRIEF DESCRIPTION OF THE DRAWINGS

FIG. 2A, FIG. 2B, and FIG. 2C are schematic views for illustrating a case where a coil is moved along an arrangement direction of two rod-like cores, which are arranged in series, from one end side to another end side in the arrangement direction, in which FIG. 2A is an illustration of a case where the coil is arranged at a position apart by 1 cm from a reference position (0 cm), FIG. 2B is an illustration of a case where the coil is arranged at a position apart by 5 cm from the reference position (0 cm), and FIG. 2C is an illustration of a case where the coil is arranged at a position apart by 12 cm from the reference position (0 cm).

DESCRIPTION OF THE EMBODIMENTS

Figure 1:
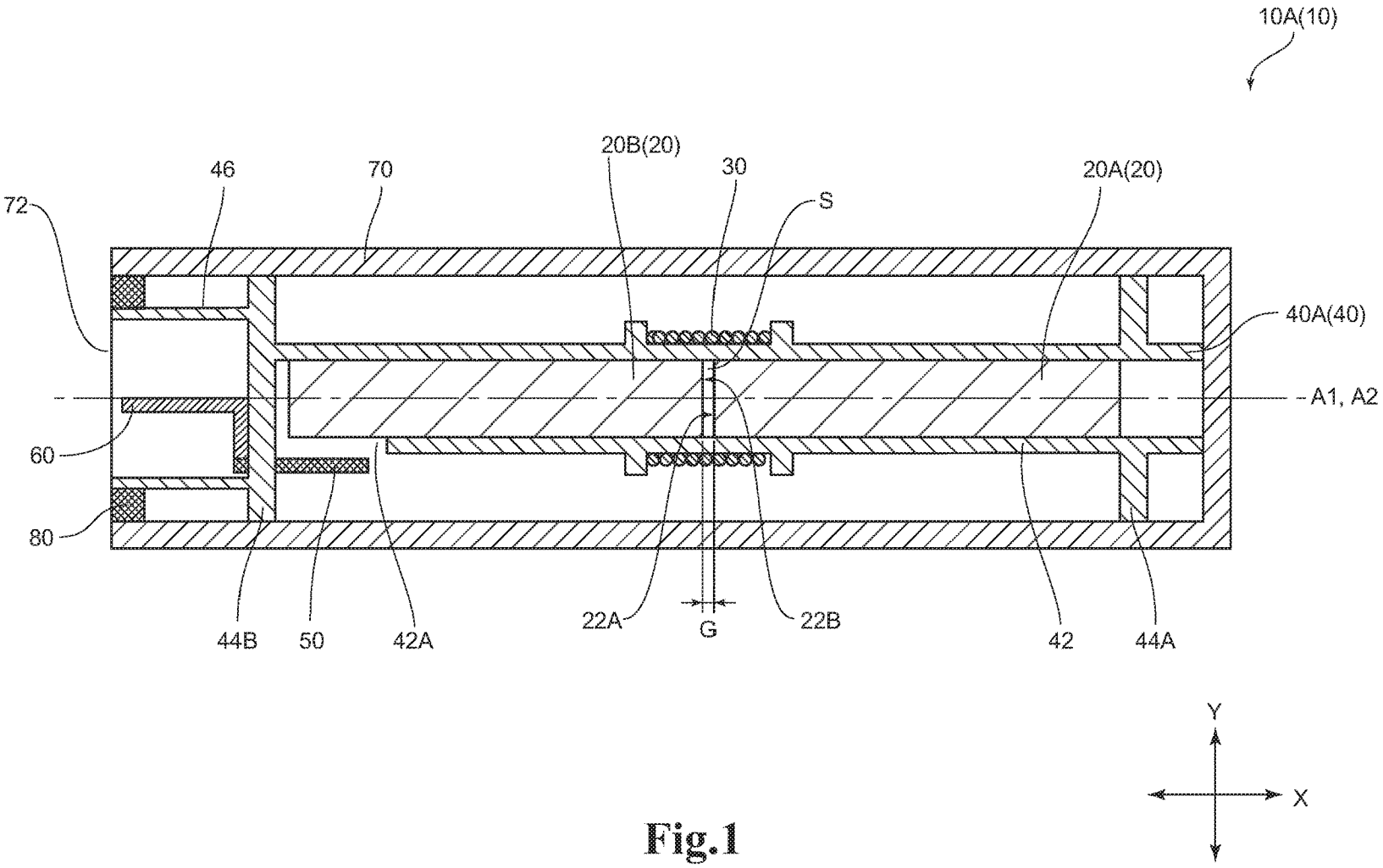
FIG. 1 is a schematic sectional view for illustrating an example of an antenna device according to an embodiment of the present invention.

FIG. 1 is a schematic sectional view for illustrating an example of an antenna device according to an embodiment of the present invention. In FIG. 1, and in FIG. 2A to FIG. 2C, and subsequent drawings described later, an X direction and a Y direction illustrated in the drawings are directions orthogonal to each other. Further, the X direction is parallel to an arrangement direction of two rod-like cores 20 illustrated in FIG. 1, and is also parallel to center axes A1 and A2 of the rod-like cores 20A (20) and 20B (20). This point is substantially the same for rod-like cores illustrated in FIG. 2A to FIG. 2C, and subsequent drawings.

An antenna device 10A (10) according to this embodiment illustrated in FIG. 1 mainly includes a plurality of (two in the example illustrated in FIG. 1) rod-like cores 20, which are arranged in series, and a coil 30, which is formed by winding a conductive wire. Further, the first rod-like core 20A and the second rod-like core 20B, which is arranged on one end portion side of the first rod-like core 20A, are arranged apart from each other. Further, the first rod-like core 20A and the second rod-like core 20B are arranged so that the center axis A1 of the first rod-like core 20A and the center axis A2 of the second rod-like core 20B match with each other.

Further, an end surface 22A of the first rod-like core 20A on a side on which the second rod-like core 20B is arranged and an end surface 22B of the second rod-like core 20B on a side on which the first rod-like core 20A is arranged are located on an inner peripheral side of the coil 30.

Further, the first rod-like core 20A and the second rod-like core 20B are accommodated in a bobbin 40A (40) having a bottomed cylindrical shape. Therefore, the coil 30 is arranged in contact with an outer peripheral surface of the bobbin 40A. Further, in the vicinity of an end portion of the bobbin 40A on a side on which the first rod-like core 20A is accommodated, there is provided a flange portion 44A protruding outward from an outer peripheral surface of a cylindrical bobbin main body portion 42. At an end portion of the bobbin 40A on a side on which the second rod-like core 20B is accommodated, there is provided a bottom lid portion 44B. The bottom lid portion 44B is provided so as to protrude outward from the outer peripheral surface of the bobbin main body portion 42. Further, on a surface of the bottom lid portion 44B on aside opposite to the side on which the bobbin main body portion 42 is provided, there is provided a cylindrical outer terminal cover 46.

Further, an opening portion 42A is formed at a part of an outer peripheral wall surface of the bobbin main body portion 42 on the bottom lid portion 44B side. A metal terminal 50 is arranged at a position of being opposed to the second rod-like core 20B exposed to the opening portion 42A. The metal terminal 50 is connected to the coil 30 by a conductive wire (not shown), and has one end penetrating through the bottom lid portion 44B and being exposed to a surface of the bottom lid portion 44B on a side opposite to the side on which the bobbin main body portion 42 is provided. The one end of the metal terminal 50 is connected to an external connection terminal 60. Further, a capacitor (not shown) such as a chip capacitor is connected to the metal terminal 50. With this configuration, the coil 30 is electrically connected to the capacitor through the metal terminal 50. Further, another electronic element which is other than the capacitor may suitably be connected to the metal terminal 50 as needed.

Further, the bobbin 40A is accommodated in the case 70 having the bottomed cylindrical shape so that the side of the bobbin 40A on which the bottom lid portion 44B is provided is located on the opening portion 72 side of the case 70. Further, a cap member 80 having a ring shape is provided between the outer peripheral surface of the outer terminal cover 46 and an inner peripheral surface of the case 70 in the vicinity of the opening portion 72.

The rod-like core 20 is made of a magnetic material. For example, a member which is manufactured by subjecting fine powder of Mn—Zn ferrite or other amorphous magnetic bodies to compression molding may suitably be used for the rod-like core 20. Further, the conductive wire constructing the coil 30 and the like is a member including a core wire, which is made of a conductive material such as copper, and an insulating material, which covers a surface of the core wire. A member made of a conductive member such as copper may suitably be used for the metal terminal 50 and the external connection terminal 60. Further, a member made of a resin material is used for the bobbin 40, the case 70, and the cap member 80. For example, a member formed by injection molding with use of polybutylene terephthalate (PBT) may be used for the bobbin 40, and a member formed by injection molding with use of polypropylene (PP) may be used for the case 70 and the cap member 80.

As exemplified in FIG. 1 and in FIG. 4 and FIG. 5 described later, in the antenna device 10 according to the this embodiment, the first rod-like core 20A and the second rod-like core 20B are arranged apart from each other, and at least one end surface selected from the end surface 22A of the first rod-like core 20A on the side on which the second rod-like core 20B is arranged, and the end surface 22B of the second rod-like core 20B on the side on which the first rod-like core 20A is arranged, is located on an inner peripheral side of the coil 30. Therefore, in the antenna device 10 according to this embodiment, the deviation between the median value of the resonance frequency distribution and the design value of the resonance frequency is easily suppressed. In the following, description is made of the reason why such an effect can be obtained.

Figures 2A, 2B, 2C:
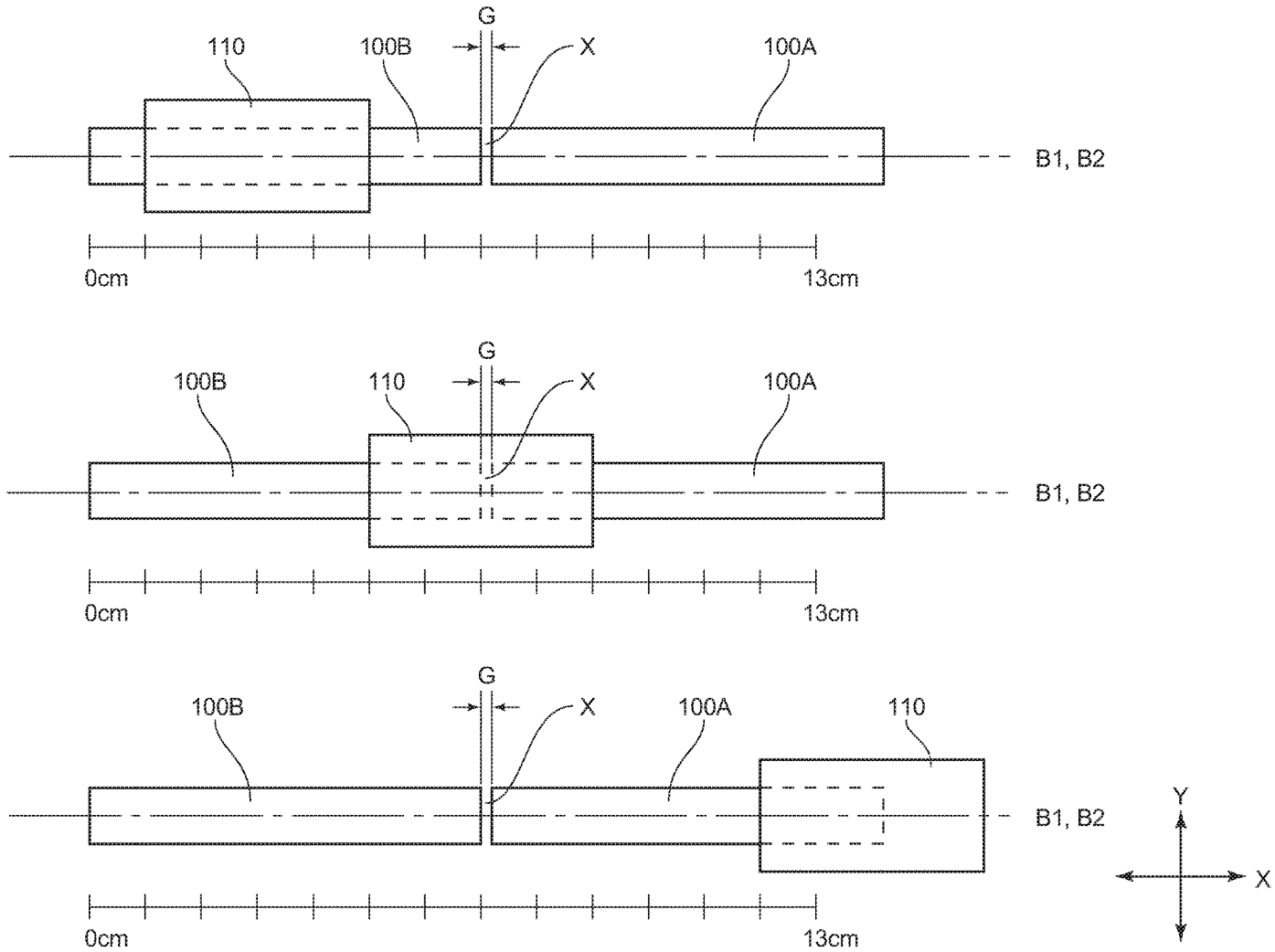
Figure 3:
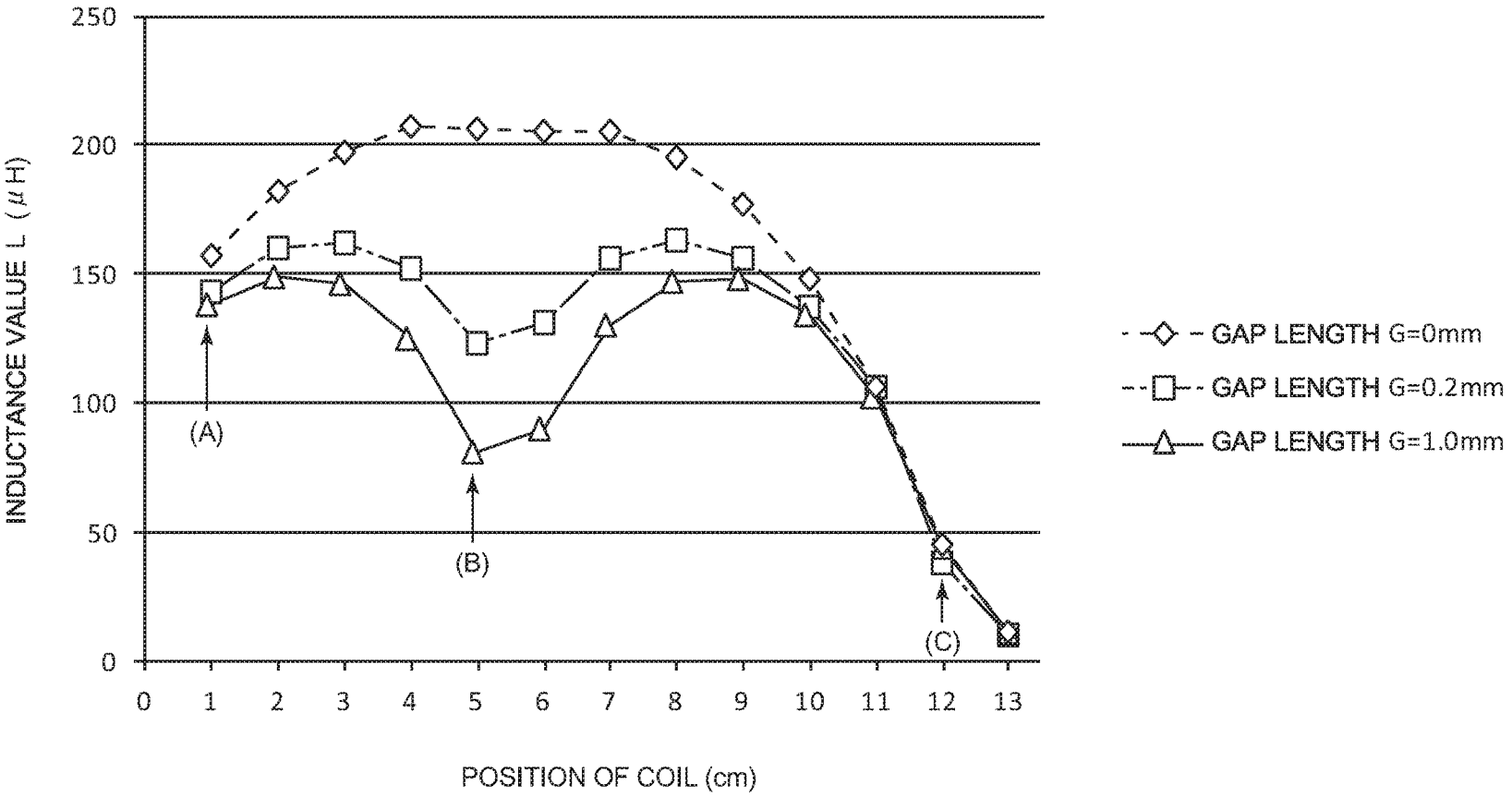
FIG. 3 is a graph for showing results of measurement for inductance values L with respect to positions of the coil in the cases illustrated in FIG. 2A, FIG. 2B, and FIG. 2C.

FIG. 2A to FIG. 2C are schematic views for illustrating a case where a coil is moved along an arrangement direction of two rod-like cores, which are arranged in series, from one end side to another end side in the arrangement direction. FIG. 3 is a graph for showing results of measurement for inductance values L with respect to positions of the coil in the cases illustrated in FIG. 2A to FIG. 2C.

As illustrated in FIG. 2A to FIG. 2C, two rod-like cores 100A and 100B are arranged in series so that a center axis B1 of the rod-like core 100A and a center axis B2 of the rod-like core 100B match with each other. Then, as illustrated in FIG. 2A, FIG. 2B, and FIG. 2C, a coil 110 is moved along the arrangement direction (X direction) of the two rod-like cores 100A and 100B from the rod-like core 100B side to the rod-like core 100A side. A length of each of the rod-like cores 100A and 100B in the direction of the center axes B1 and B2 is 7 cm, and a length of the coil 110 in a direction parallel to the arrangement direction of the rod-like cores 100A and 100B is 4 cm. Further, in a case where an end surface of the rod-like core 100B on a side opposite to the side on which the rod-like core 100A is arranged is defined as a reference position (0 cm), a position of the coil 110 is indicated by a distance from the reference position to an end portion of the coil 110 on the reference position side.

FIG. 2A is an illustration of a case where the coil 110 is arranged at a position apart by 1 cm from the reference position. FIG. 2B is an illustration of a case where the coil 110 is arranged at a position apart by 5 cm from the reference position. FIG. 2C is an illustration of a case where the coil 110 is arranged at a position apart by 12 cm from the reference position. Further, at a position apart by 7 cm from the reference position, there is formed a contact portion X (gap length G=0 mm) or a gap portion X (gap length G>0 mm) between the first rod-like core 100A and the second rod-like core 100B. For the measurement of the inductance value L, there are given three reference conditions of 0 mm, 0.2 mm, and 1.0 mm for the gap length G between the rod-like core 100A and the rod-like core 100B. Conditions other than the gap lengths G and the positions of the coil 110 from the reference position are all set to fixed conditions.

In FIG. 3, the horizontal axis represents a position (cm) of the coil 110, and the vertical axis represents an inductance value L (μH). The inductance values L indicated by the reference symbols (A), (B), and (C) in FIG. 3 correspond to the states in which the coil 110 is arranged at the positions illustrated in FIG. 2A, FIG. 2B, and FIG. 2C, respectively.

As is apparent from the results shown in FIG. 3, when the gap length G is more than 0 mm, the inductance value L exhibits a maximum value as the coil 110 approaches a center portion of the second rod-like core 100B in the center axis B2 direction, and thereafter is lowered as the coil 110 approaches the gap portion X. Further, the inductance value L exhibits a minimum value when the gap portion X is located in the vicinity of the center portion of the coil 110 in a length direction of the coil 110. Further, the inductance value L again exhibits a maximum value as the coil 110 moves away from the gap portion X and approaches a center portion of the first rod-like core 100A in the center axis B1 direction, and thereafter is lowered again as the coil 110 approaches the end portion side of the first rod-like core 100A, that is, the end portion on a side opposite to a side on which the second rod-like core 100B is arranged. That is, the inductance value L changes so as to plot an M-shaped curve with respect to positions of the coil 110. Further, a difference between the maximum value and the minimum value of the inductance values L becomes more remarkable as the gap length G increases.

That is, when the gap length G is 0 mm, in other words, when it is equivalent to a state in which one elongated rod-like core formed by connecting and integrating the two rod-like cores 100A and 100B to each other is used, the inductance value L may be large regardless of the position of the coil 110. Therefore, the inductance value per turn is increased, with the result that there is difficulty in finely adjusting the resonance frequency by increasing or decreasing the number of windings of the coil 110 in units of integer.

Further, even in a case where the gap length G between the two rod-like cores 100A and 100B is more than 0 mm, when the coil 110 is arranged at a position not overlapping with the vicinity of the gap portion X as exemplified in FIG. 2A and FIG. 2C, the inductance value L may be large. Also in this case, similarly to the case where the gap length G is 0 mm, the inductance value per turn is increased, with the result that there is difficulty in finely adjusting the resonance frequency by increasing or decreasing the number of windings of the coil 110 in units of integer.

However, when (i) the gap length G is more than 0 mm, and (ii) as illustrated in FIG. 2B, the coil 110 is located at a position overlapping with the vicinity of the gap portion X, in other words, the vicinity of the end portion of the first rod-like core 110A on the side on which the second rod-like core 110B is arranged and the vicinity of the end portion of the second rod-like core 100B on the side on which the first rod-like core 100A is arranged are located on the inner peripheral side of the coil 110, the inductance value L exhibits a minimum value. In this case, the inductance value per turn is small. Therefore, the fine adjustment of the resonance frequency by increasing or decreasing the number of windings of the coil 110 in units of integer is easily performed.

Therefore, as in the antenna device 10A according to this embodiment illustrated in FIG. 1, when the coil 30 is arranged so that the end surfaces 22A and 22B of the two rod-like cores 20A and 20B are located on the inner peripheral side of the coil 30, the resonance frequency can finely be adjusted by increasing or decreasing the number of windings of the coil 30 in units of integer. Therefore, deviation between a median value of the resonance frequency distribution of the antenna device 10 according to this embodiment, which is actually manufactured, and the design value of the resonance frequency is easily suppressed.

As is apparent from FIG. 2A to FIG. 2C and FIG. 3, in the case where the gap length G is more than 0 mm, the inductance value L exhibits a minimum value when the coil 110 is located in the vicinity of the gap portion X. Further, when the coil 30 is formed by winding the conductive wire at the time of manufacture of the antenna device 10, the conductive wire is sequentially wound from one side to another side in the arrangement direction of the rod-like cores 20A and 20B. In consideration of those points, at the time of forming the coil 30, it is most advantageous to provide a winding position of first several windings or last several windings which may serve as an adjustment zone for the fine adjustment of the resonance frequency (position in the vicinity of any one of end portion sides of the completed coil 30 in a length direction of the coil 30) in the vicinity of a region S formed between the end surface 22A of the first rod-like core 20A on the side on which the second rod-like core 20B is arranged and the end surface 22B of the second rod-like core 20B on the side on which the first rod-like core 20A is arranged.

Figure 4:
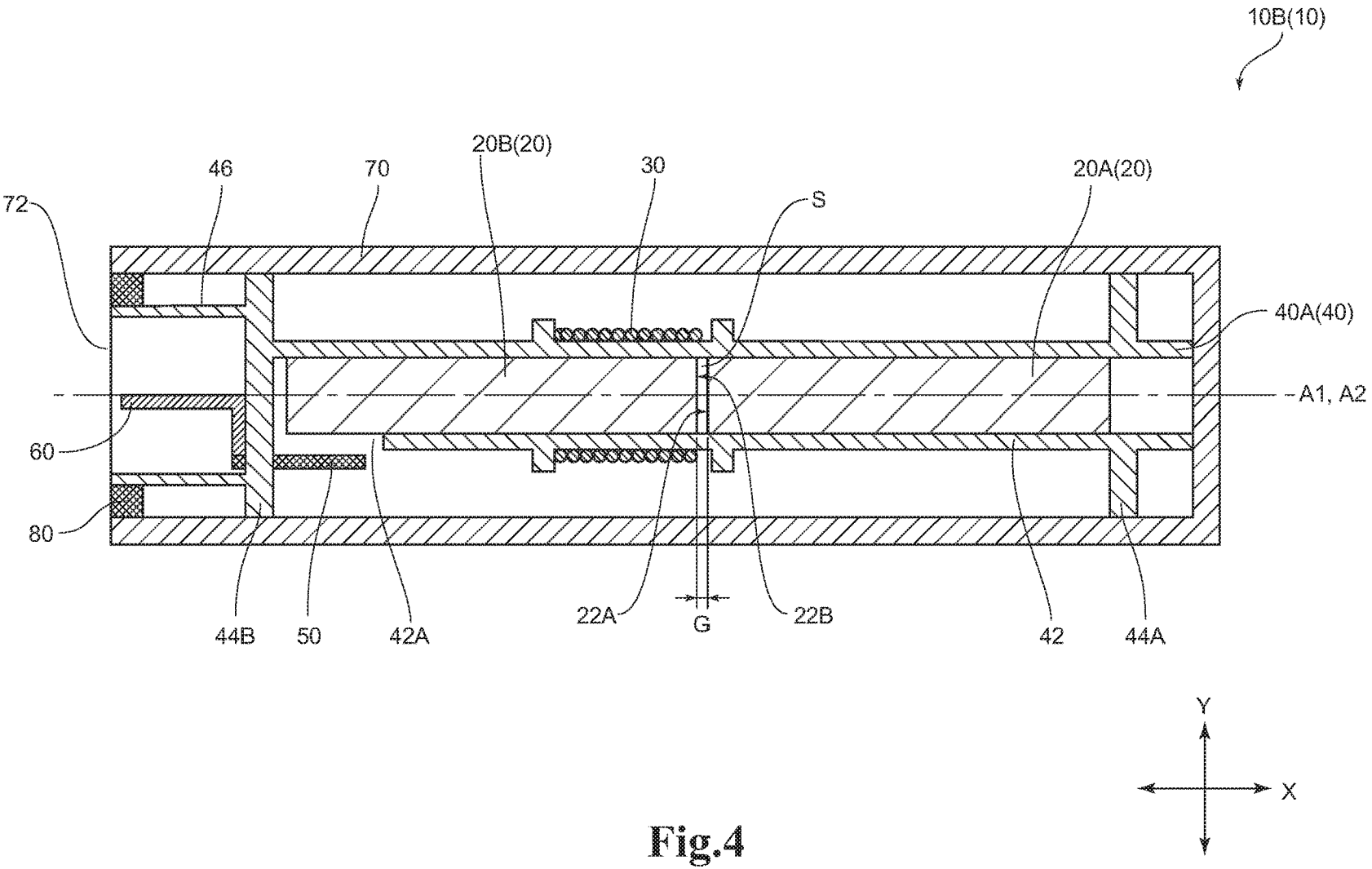
FIG. 4 is a schematic sectional view for illustrating another example of the antenna device according to the embodiment of the present invention.
Figure 5:
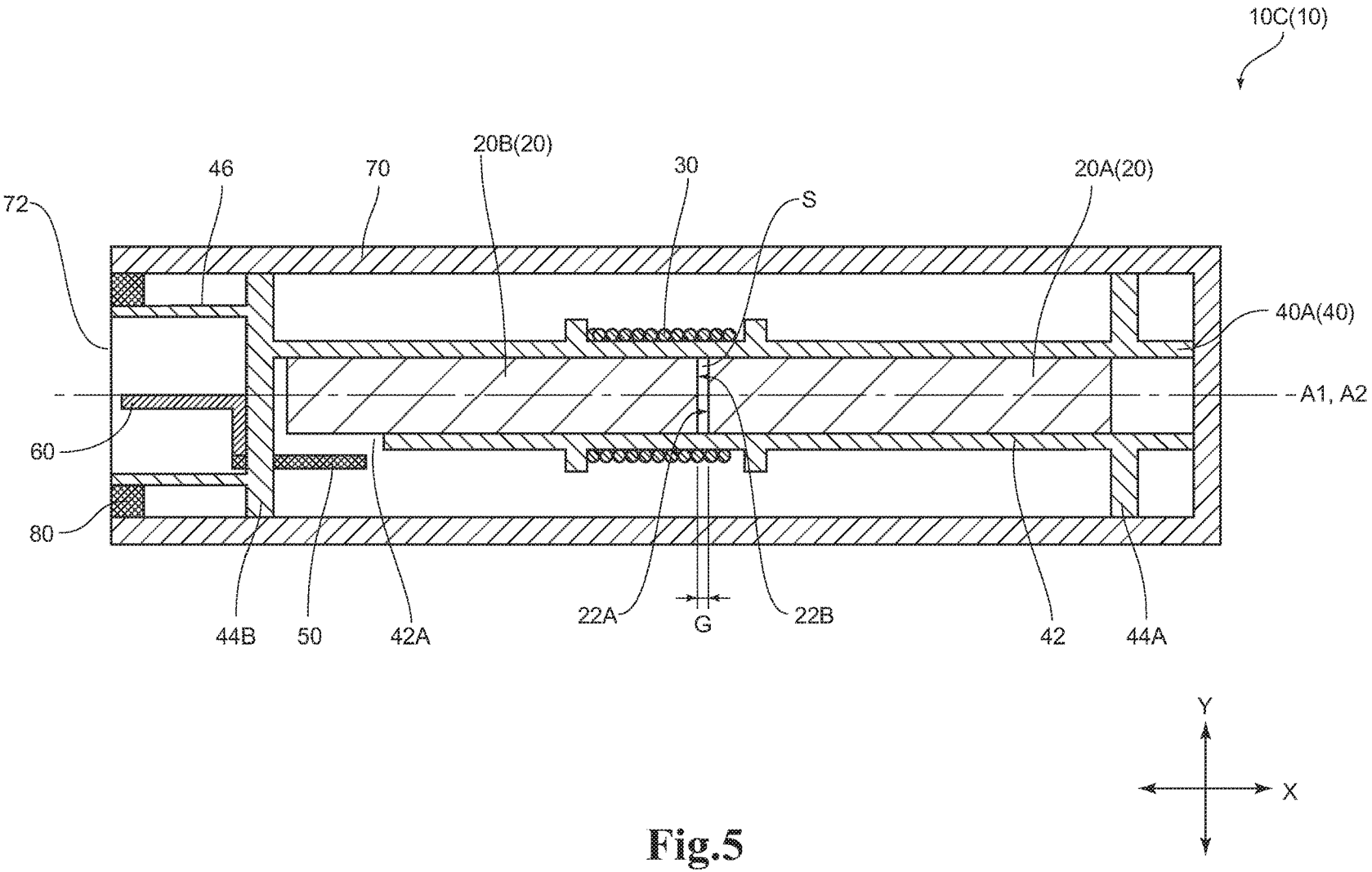
FIG. 5 is a schematic sectional view for illustrating another example of the antenna device according to the embodiment of the present invention.

Therefore, in view of ease in fine adjustment of the resonance frequency, the antenna devices 10B (10) and 10C (10) exemplified below in FIG. 4 and FIG. 5 are more desirable than the antenna device 10A exemplified in FIG. 1. In the antenna device 10B illustrated in FIG. 4, the coil 30 is arranged so that the end surface 22B of the second rod-like core 20B on the side on which the first rod-like core 20A is arranged and a portion of the second rod-like core 20B which is closer to the vicinity of the end surface 22B side are located on the inner peripheral side of the coil 30. Other than this point, the antenna device 10B illustrated in FIG. 4 has substantially the same configuration as that of the antenna device 10A illustrated in FIG. 1.

Further, in the antenna device 10C illustrated in FIG. 5, the end surface 22A of the first rod-like core 20A on the side on which the second rod-like core 20B is arranged and the end surface 22B of the second rod-like core 20B on the side on which the first rod-like core 20A is arranged are located on the inner peripheral side of the coil 30. Further, the first rod-like core 20A and the second rod-like core 20B in the vicinity of both sides of the region S formed between the end surface 22A and the end surface 22B are also located on the inner peripheral side of the coil 30, but the coil 30 is arranged remarkably closer to the second rod-like core 20B side. Other than this point, the antenna device 10C illustrated in FIG. 5 has substantially the same configuration as that of the antenna device 10A illustrated in FIG. 1.

As exemplified in FIG. 1, FIG. 4, and FIG. 5, in the antenna device 10 according to this embodiment, it is only necessary that at least one end surface selected from the end surface 22A of the first rod-like core 20A on the side on which the second rod-like core 20B is arranged and the end surface 22B of the second rod-like core 20B on the side on which the first rod-like core 20A is arranged be located on the inner peripheral side of the coil 30. However, in the viewpoint of ease in fine adjustment of the resonance frequency through adjustment of the number of windings of the coil 30, it is desirable that the coil 30 be arranged in a non-symmetrical manner as exemplified in FIG. 4 and FIG. 5 rather than being arranged in a symmetrical manner as exemplified in FIG. 1 with respect to the region S in the arrangement direction of the rod-like cores 20A and 20B. This is because the fine adjustment of the resonance frequency is further easily performed through adjustment of the number of windings at the end portion of one of the both end portions of the coil 30 on the side relatively closer to the region S at the time of forming the coil 30 when the coil 30 is arranged so as to be non-symmetrical with respect to the region S.

In addition, a coil portion of the coil 30, which is in the vicinity of an end portion relatively far from the region S, is located in the vicinity of the center portion of the rod-like core 20. As is apparent from the graph shown in FIG. 3, the coil portion located in the vicinity of the center portion of the rod-like core 20 contributes also to the increase in inductance value L of the antenna device 10 as a whole.

Therefore, with the antenna devices 10B and 10C exemplified in FIG. 4 and FIG. 5 in which the coil 30 is arranged so as to be non-symmetrical with respect to the region S, as compared to the antenna device 10A exemplified in FIG. 1 in which the coil 30 is arranged so as to be symmetrical with respect to the region S, larger inductance value L is easily obtained in the antenna device 10 as a whole, and the fine adjustment of the resonance frequency becomes easier.

Further, in order to further obtain more function or effect in addition to the ease in fine adjustment of the resonance frequency, a coil other than the coil 30 arranged in the vicinity of the region S may further be used. In this case, the number of windings of the coil 30 may be suppressed to several turns only for the purpose of the fine adjustment of the resonance frequency. Such antenna device 10 includes, for example, antenna devices 10D, 10E, and 10F illustrated in FIG. 6 to FIG. 8.

Figure 6:
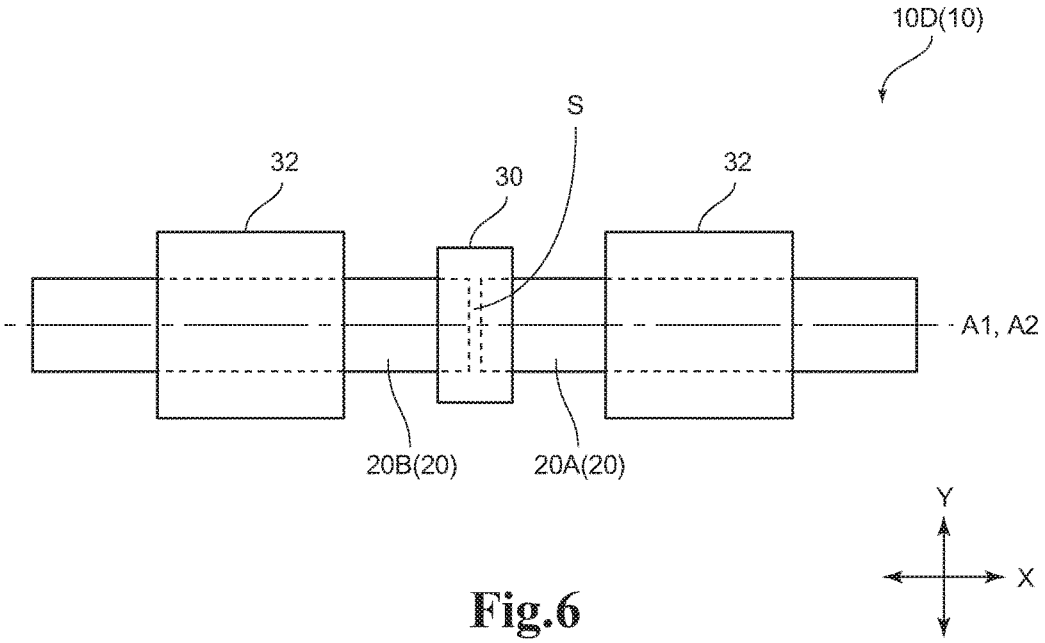
FIG. 6 is a schematic view for illustrating another example of the antenna device according to the embodiment of the present invention.
Figure 7:
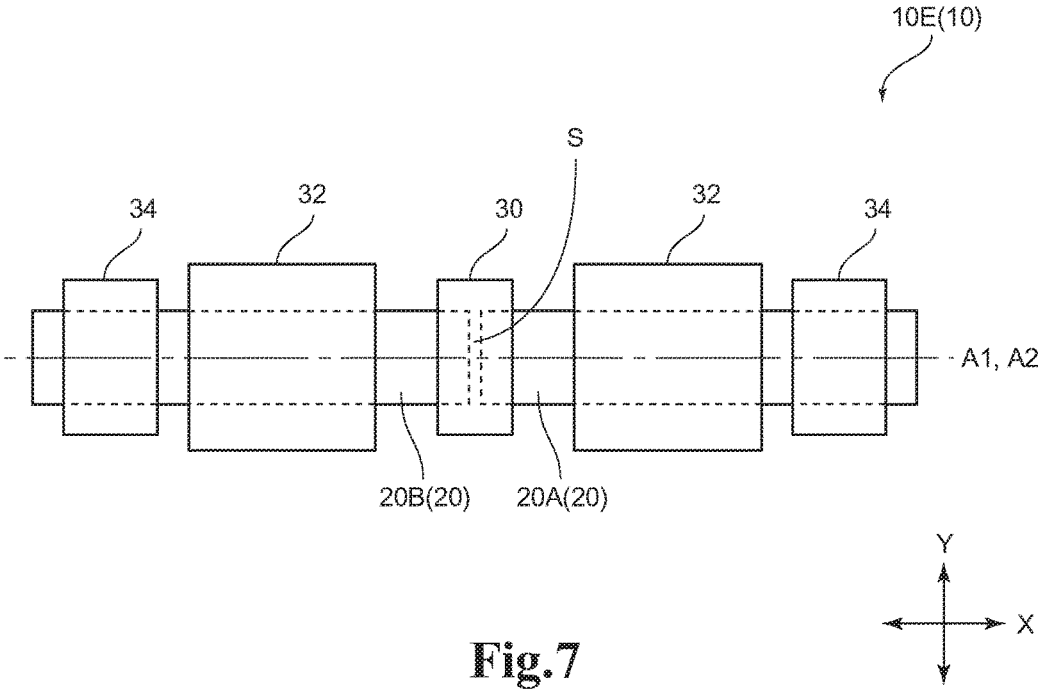
FIG. 7 is a schematic view for illustrating another example of the antenna device according to the embodiment of the present invention.
Figure 8:
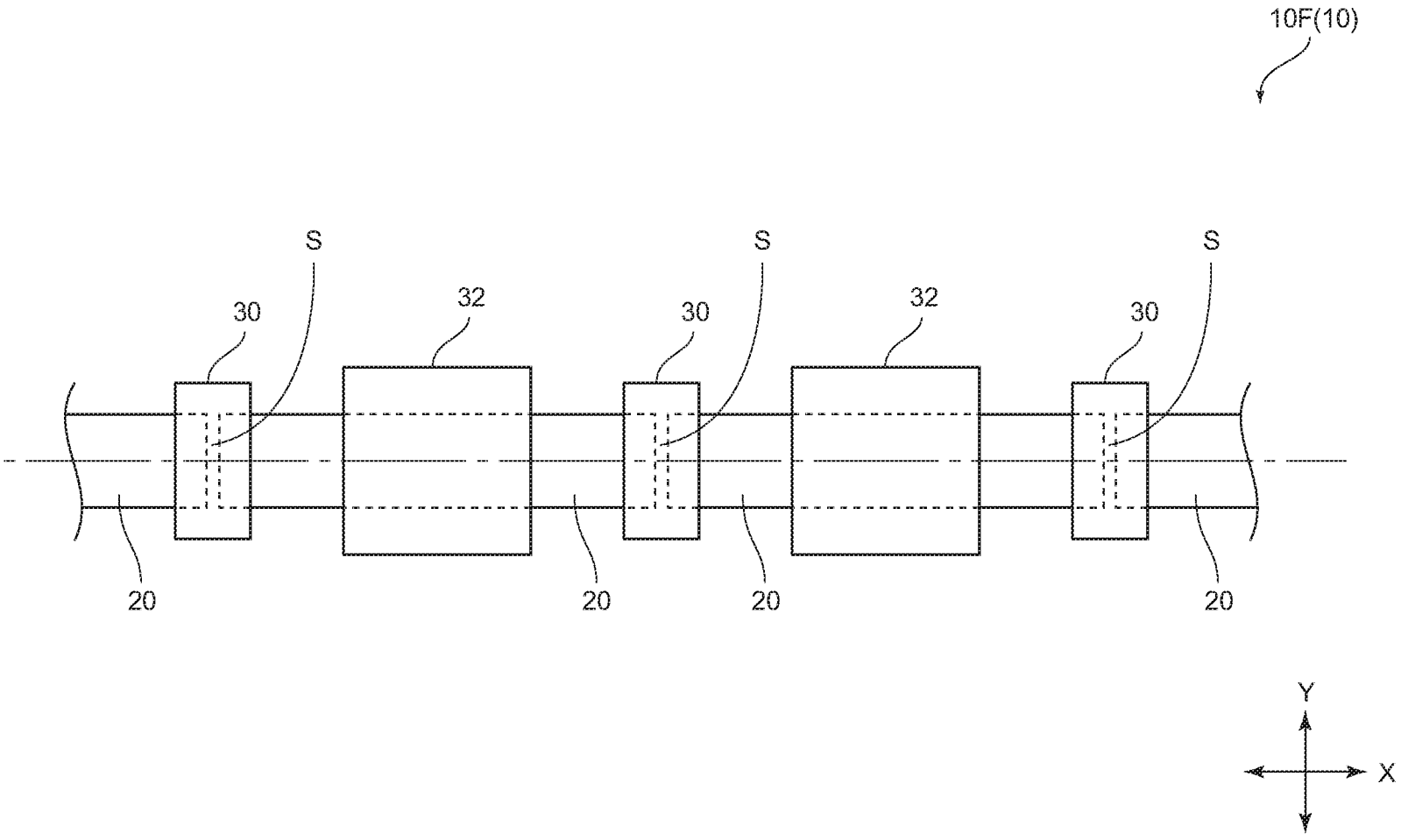
FIG. 8 is a schematic view for illustrating another example of the antenna device according to the embodiment of the present invention.

In FIG. 6 to FIG. 8, illustration of members other than the core 20 and coils 30, 32, and 34 being main parts of the antenna devices 10D, 10E, and 10F is omitted.

In the antenna device 10D illustrated in FIG. 6, as compared to the antenna device 10A illustrated in FIG. 1, there are further arranged coils 32 in the vicinity of the center portion of the first rod-like core 20A and the second rod-like core 20B in the X direction. In the antenna device 10D, the number of windings of the coil 30 is about several turns to perform the fine adjustment of the resonance frequency. With this configuration, the coils 32 each having a larger number of windings than the coil 30 increase the inductance value L of the antenna device 10D as a whole, thereby improving an output of the antenna device 10D.

In the antenna device 10E illustrated in FIG. 7, as compared to the antenna device 10D illustrated in FIG. 6, there are further provided two auxiliary coils 34. One auxiliary coil 34 is arranged in the vicinity of the end portion of the first rod-like core 20A on a side opposite to the side on which the coil 30 is arranged. Another auxiliary coil 34 is arranged in the vicinity of the end portion of the second rod-like core 20B on a side opposite to the side on which the coil 30 is arranged. With the two additional auxiliary coils 34, the antenna device 10E illustrated in FIG. 7 can obtain a larger output as compared to the antenna device 10D illustrated in FIG. 6.

The antenna device 10F illustrated in FIG. 8 is a modification example of the antenna device 10D illustrated in FIG. 6, specifically, is an illustration of one example of the antenna device 10 in a case where three or more rod-like cores 20 arranged in series are used. A one-dot chain line being parallel to the X direction illustrated in FIG. 8 is oriented in a direction matching with a center axis of each rod-like core 20. In the antenna device 10F, the coil 30 is arranged in the vicinity of the region S formed between two rod-like cores 20 being adjacent to each other in the X direction, and the coil 32 is arranged in the vicinity of a center portion of each rod-like core 20 in the X direction. Therefore, the coils 30 and the coils 32 are arranged in an alternately repeated manner along the X direction. In the antenna device 10F illustrated in FIG. 8, the number of windings of at least one coil 30 of the plurality of coils 30 is adjusted to finely adjust the resonance frequency, and the number of windings of the remainder of the coils 30 can all be set constant.

In the antenna devices 10D, 10E, and 10F illustrated in FIG. 6 to FIG. 8, it is preferred that the length of each of the coils 32 in the X direction be equal to or less than a half of the length of the rod-like core 20 in the X direction.

The individual capacitance variation of the capacitor used for the antenna device 10 according to this embodiment is not particularly limited. However, in a case of a capacitor used for a general antenna device, the individual capacitance variation of equal to or more than ±1% can exhibit a significant effect in practice. When the individual capacitance variation is less than ±1%, there is difficulty in obtaining the capacitor, or the cost for the capacitor significantly increases, resulting in lack of practicability in some cases. Further, in the antenna device 10 according to this embodiment, instead of reducing the number of ranks for classification of the capacitors used for manufacture of the antenna devices 10, inexpensive capacitors having significant individual capacitance variation may also be used easily. In this viewpoint, the individual capacitance variation may be equal to or more than ±10%. However, when the individual capacitance variation is excessively significant, it is necessary to classify the capacitors into a large number of ranks and adjust the number of windings of the coil 30 for each rank, with the result that the manufacturing processing is complicated. Therefore, it is preferred that the individual capacitance variation be equal to or less than ±5%. Further, in order to simplify the classification into ranks, it is more preferred that the individual capacitance variation be equal to or less than ±3%.

Figure 9:
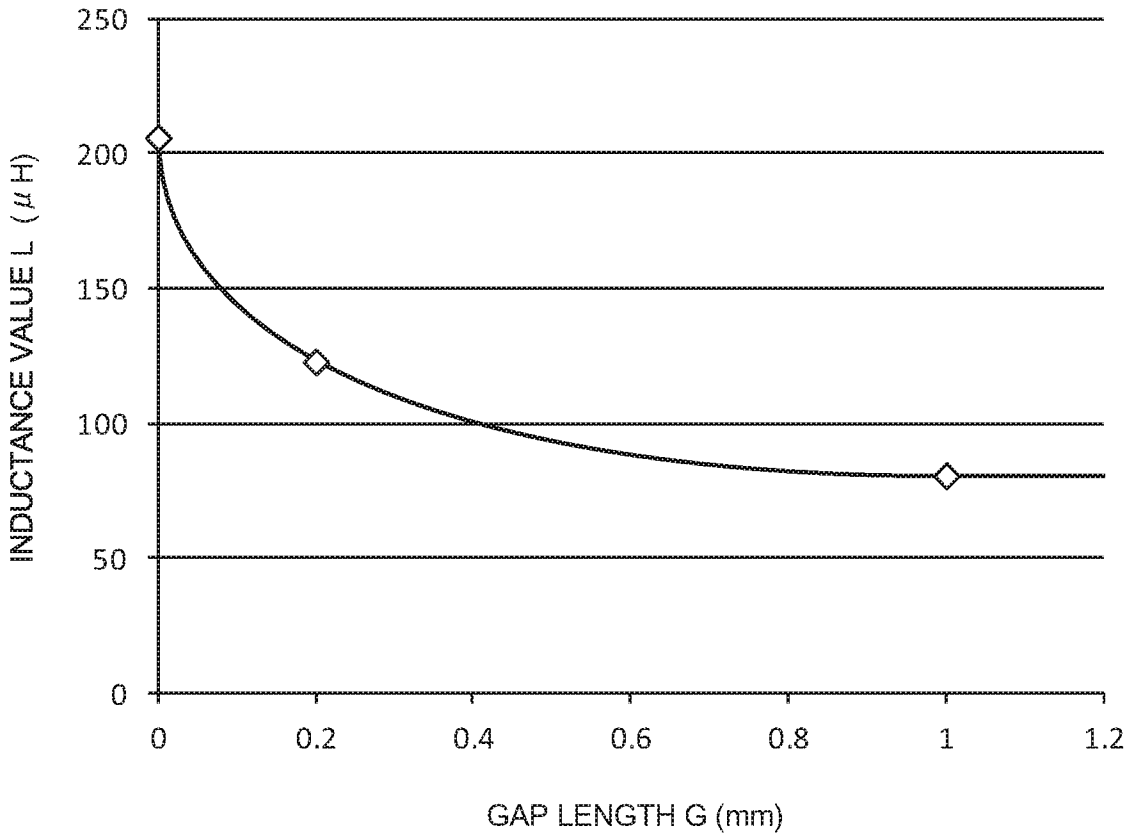
FIG. 9 is a graph for showing a change in inductance value with respect to a gap length G in the case where the position of the coil is set as illustrated in FIG. 2B.

Further, in the antenna device 10 according to this embodiment, it is only necessary that the first rod-like core 20A and the second rod-like core 20B be arranged apart from each other, that is, the gap length G be more than 0 mm. However, it is preferred that the gap length G be in the range of from 0.2 mm to 1.0 mm, more preferably from 0.3 mm to 0.8 mm. FIG. 9 is a graph for showing a change in inductance value with respect to the gap length G in a case where a position of the coil 110 is set as illustrated in FIG. 2B. Also in the antenna devices 10 according to this embodiment exemplified in FIG. 1, FIG. 4, and FIG. 5, the coil 30 is arranged at a position the same as or close to the position of the case illustrated in FIG. 2B. Therefore, the tendency of the change in inductance value with respect to the gap length G shown in FIG. 9 may be the same in the antenna device 10 according to this embodiment.

As is apparent from the graph shown in FIG. 9, when the gap length G is less than 0.2 mm, the inductance value L of the antenna device 10 as a whole becomes excessively larger, and hence the inductance value per turn of the coil 30 also becomes larger. As a result, there is a case where the fine adjustment of the resonance frequency tends to be difficult.

Further, variation in gap length G in individual antenna devices 10 or in the same antenna device 10 due to the temperature change is inevitable. Therefore, when the gap length G is less than 0.2 mm, the inductance value per turn affected by the gap length G is also liable to vary. Also in this point, there is a case where the fine adjustment of the resonance frequency tends to become more difficult. Meanwhile, when the gap length G is more than 1.0 mm, there is a case where the inductance value L of the antenna device 10 as a whole tends to become excessively smaller.

In the antenna device 10 according to this embodiment, there is no need to provide the resonance frequency adjustment mechanism such as the small-size core disclosed in Japanese Patent Application Laid-open No. 2007-43588. Therefore, the manufacturing method for the antenna device 10 according to this embodiment is not particularly limited except for the point that the step of incorporating the resonance frequency adjustment mechanism such as the small-size core disclosed in Japanese Patent Application Laid-open No. 2007-43588 may be omitted. However, a first manufacturing method or a second manufacturing method described below is preferred.

The first manufacturing method includes at least classifying capacitors of the same type used for manufacture of the antenna device 10 into two or three ranks in accordance with capacitances of individual capacitors and forming the coil 30 by setting the number of windings of the conductive wire to a different value in accordance with a rank of an individual capacitor and by winding the conductive wire, to thereby manufacture the antenna device 10 according to this embodiment. With this method, the number of variations in the number of windings of the conductive wire constructing the coil 30 in the manufactured antenna device 10 may be two or three. For example, the capacitors having the individual capacitance variation of ±5% are classified into two ranks including a first-class capacitor having a capacitance within a variation range of equal to or more than −5% and less than 0% and a second-class capacitor having a capacitance within a variation range of equal to or more than 0% and equal to or less than 5%. When the antenna device 10 is manufactured with use of the first-class capacitor, the number of windings of the coil 30 is set to X so that the resonance frequency is within the target tolerance of the resonance frequency. When the antenna device 10 is manufactured with use of the second-class capacitor, the number of windings of the coil 30 may be set to Y. However, $X \neq Y$ is satisfied, and a value of $|X-Y|$ is an integer value of equal to or more than 1. In this case, in the antenna device 10 manufactured by the first manufacturing method, the number of variations in the number of windings of the coil 30 of each antenna device is two.

The second manufacturing method includes at least forming the coil 30 by winding the conductive wire under a state in which the number of windings of the conductive wire is always set to a constant value regardless of the capacitances of individual capacitors of the same type used for manufacture of the antenna device 10, to thereby manufacture the antenna device 10 according to this embodiment. That is, in the antenna device 10 manufactured by the second manufacturing method, the number of windings of the coil 30 of each of all of the antenna devices is equal, that is, the number of variations in the number of windings is only one.

Therefore, at the time of manufacturing the antenna device 10, when the first manufacturing method or the second manufacturing method is employed, the number of variations in the number of windings of the conductive wire constructing the coil 30 of the manufactured antenna device 10 is any one of one to three.

Further, as described above, in the antenna device 10 according to this embodiment, the inductance value per turn at the time of increasing or decreasing the number of windings of the coil 30 in units of integer is small. Accordingly, the fine adjustment of the resonance frequency is easily performed. Therefore, even when the number of ranks at the time of classifying the capacitors in accordance with the capacitances is reduced to two or three, or classifying the capacitors is omitted, the antenna device 10 having the resonance frequency within the required tolerance range of the resonance frequency can be manufactured in an extremely easy manner. That is, as compared to the case where the number of classification ranks is four or five at the time of classifying the capacitors as in the related art, the manufacturing process for the antenna device 10 can be simplified. Further, classifying the capacitors is not required in the second manufacturing method, thereby being capable of further simplifying the manufacturing process for the antenna device 10.

In the antenna device 10 according to this embodiment described above, the variation in resonance frequency of the individual antenna devices 10 can be set to equal to or less than ±2% in an extremely easy manner, thereby being capable of dealing with the required specification with the tolerance of resonance frequency of equal to or less than ±2%. However, the required tolerance of resonance frequency may vary in accordance with the intended use of the antenna device 10 or the like. Therefore, the variation in resonance frequency of the individual antenna devices 10 may be more than ±2%. Further, the manufacturing method for the antenna device 10 may suitably be selected in accordance with the individual capacitance variation of the capacitor used for manufacture, the required tolerance of resonance frequency, or the like. For example, when (a) the required tolerance of resonance frequency is narrower, and/or the individual capacitance variation of the capacitors used for manufacture is larger, the first manufacturing method is more preferred. When (b) the required tolerance of resonance frequency is larger, and/or the individual capacitance variation of the capacitors used for manufacture is smaller, the second manufacturing method is more preferred.

In FIG. 1, FIG. 4, and FIG. 5, there is exemplified the antenna device 10 including the two rod-like cores 20. However, the antenna device 10 according to this embodiment may include three or more rod-like cores 20. In this case, it is only necessary that at least any two rod-like cores 20, which are selected from the plurality of rod-like cores 20 and are positioned adjacent to each other in the arrangement direction of the plurality of rod-like cores 20, and at least one coil 30 satisfy the arrangement relationship as exemplified in FIG. 1, FIG. 4, or FIG. 5.

Further, in the antenna device 10 according to this embodiment, it is only necessary that the first rod-like core 20A and the second rod-like core 20B be arranged apart from each other, that is, the gap length G be more than 0 mm. A simple gap, that is, a space taken by air may be formed between the first rod-like core 20A and the second rod-like core 20B. However, it is preferred that an adhesive layer or a spacer formed of a plate-like resin member or the like be arranged between the first rod-like core 20A and the second rod-like core 20B. When the adhesive layer or the spacer is provided between the first rod-like core 20A and the second rod-like core 20B, a change in gap length G can be suppressed. Therefore, in a region having a particularly small gap length G, which is more than 0 mm to about 0.4 mm, more preferably, from about 0.2 mm to about 0.4 mm, variation in inductance value L and resonance frequency is suppressed in an extremely easy manner.

Figure 10:
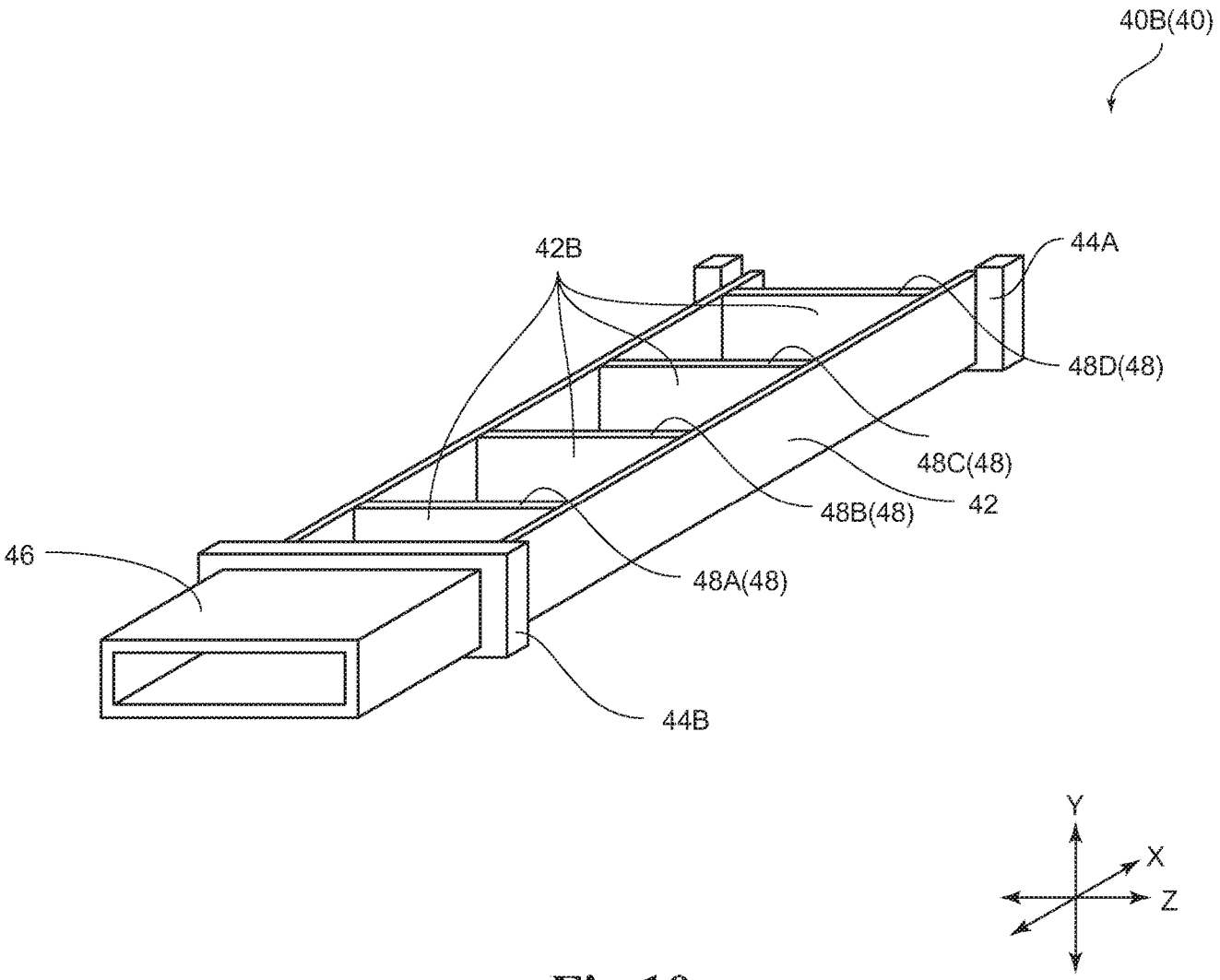
FIG. 10 is an appearance perspective view for illustrating another example of a bobbin which is used for the antenna device according to the embodiment of the present invention.

When a partition plate is provided in the bobbin 40, the partition plate may be used as the spacer. FIG. 10 is an appearance perspective view for illustrating another example of the bobbin used for the antenna device 10 according to this embodiment. In FIG. 10, the X direction, the Y direction, and a Z direction are directions orthogonal to each other. A bobbin 40B (40) illustrated in FIG. 10 includes four partition plates 48. The four partition plates 48 are arranged in the bobbin main body portion 42 so as to partition the inside of the bobbin main body portion 42 at equal intervals in the longitudinal direction of the bobbin main body portion 42. Further, opening portions 42B are formed on an entire surface of the bobbin main body portion 42 on a side opposite to the side on which the opening portion 42A (not shown in FIG. 10) is formed. Other than those points, the bobbin 40B has substantially the same structure as those of the bobbins 40A illustrated in FIG. 1, FIG. 4, and FIG. 5.

When the bobbin 40B illustrated in FIG. 10 is used, the rod-like cores 20 are arranged between the bottom lid portion 44B and the partition plate 48A, between the partition plate 48A and the partition plate 48B, between the partition plate 48B and the partition plate 48C, and between the partition plate 48C and the partition plate 48D, thereby being capable of arranging four rod-like cores 20 in total in series in the bobbin 40B. Further, the coil 30 is arranged so that at least any one of the partition plates 48, which is selected from the four partition plates 48, and the vicinities of end portions of rod-like cores 20, which are arranged on both sides of the selected partition plate 48, on the partition plate 48 side are located on the inner peripheral side of the coil 30.

With the bobbin 40B including the partition plates 48 as exemplified in FIG. 10, the plurality of rod-like cores 20 can easily and stably be held in the bobbin 40B. Further, the entire surface on one side of the bobbin main body portion 42 has the opening portions 42B which are formed by removing the outer peripheral wall surface constructing the bobbin main body portion 42. Therefore, the bobbin main body portion 42 can further be reduced in thickness, and the plurality of rod-like cores 20 can be simultaneously inserted into the bobbin 40B from the same direction and arranged therein. In addition, a mold which is used at the time of molding the bobbin 40B with use of a resin material and a mold can also be manufactured in an easy and inexpensive manner. In consideration of a centrifugal force at the time of winding the wire on the bobbin 40B, technologies which are generally used in this field, such as use of a lid member for closing the opening portions 42B and appropriate meshing members, may further be used.

What is claimed is:

1. An antenna device, comprising:

a plurality of rod-like cores arranged in series in an axial direction, the plurality of rod-like cores including first and second rod-like cores that are arranged directly adjacent to each other via a gap;

a first coil formed by winding a conductive wire around part of the plurality of rod-like cores; and a capacitor electrically connected to the first coil, wherein a first end surface of the first rod-like core directly faces a second end surface of the second rod-like core via the gap, and at least one of the first end surface and the second end surface is located on an inner peripheral side of the first coil, and a length of the first coil in the axial direction is shorter than each of the first and second rod-like cores in the axial direction.

2. The antenna device according to claim 1, wherein the first and second end surfaces are located on the inner peripheral side of the first coil.

3. The antenna device according to claim 2, wherein the gap between the first and second rod-like cores in the axial direction is in a range of 0.2 mm to 1.0 mm.

4. The antenna device according to claim 1, wherein the first coil is arranged in a non-symmetrical manner with respect to the gap between the first and second rod-like cores.

5. The antenna device according to claim 4, wherein the gap between the first and second rod-like cores in the axial direction is in a range of 0.2 mm to 1.0 mm.

6. The antenna device according to claim 1, wherein the capacitor is selected from a plurality of capacitors, and an individual capacitance variation of the plurality of capacitors is ±1% or more.

7. The antenna device according to claim 6, wherein the gap between the first and second rod-like cores in the axial direction is in a range of 0.2 mm to 1.0 mm.

8. The antenna device according to claim 1, wherein the gap between the first and second rod-like cores in the axial direction is in a range of 0.2 mm to 1.0 mm.

9. The antenna device according to claim 1, wherein a number of the windings of the conductive wire is selected from three pre-selected different numbers.

10. The antenna device according to claim 1, wherein a variation in resonance frequency of individual antenna devices of a plurality of the antenna devices is equal to or less than ±2%.

11. The antenna device according to claim 1, wherein the first coil is disposed in the vicinity of the gap.

12. The antenna device according to claim 1, further comprising:

a second coil formed by winding the conductive wire around part of the first rod-like core; and a third coil formed by winding the conductive wire around part of the second rod-like core, wherein the second coil is disposed in the vicinity of a center of the first rod-like core in the axial direction, and the third coil is disposed in the vicinity of a center of the second rod-like core in the axial direction.

13. The antenna device according to claim 12, wherein the first coil completely overlaps the gap when viewed in a second direction perpendicular to the axial direction, and the length of the first coil in the axial direction is shorter than each of the second and third coils in the axial direction.

14. The antenna device according to claim 13, wherein lengths of the second and third coils in the axial direction are equal to or less than half of the first and second rod-like cores, respectively.

15. The antenna device according to claim 1, wherein the other end surface of the first rod-like core that is opposite to the first end surface is provided without a flange, and the other end surface of the second rod-like core that is opposite to the second end surface is provided without a flange.

16. The antenna device according to claim 1, wherein the length of the first coil in the axial direction is equal to or less than a half of each of the first and second rod-like cores in the axial direction.

17. The antenna device according to claim 1, wherein each of lengths of the first and second rod-like cores in the axial direction is in a range of about 70 to 350 times of the length of the first coil in the axial direction.

18. The antenna device according to claim 1, further comprising:

a bobbin that houses the plurality of rod-like cores, a first part of the bobbin is cut at the other end surface of the second rod-like core that is opposite to the second end surface;

a case that houses the bobbin and the first coil; and a first terminal that is disposed directly adjacent to the first part of the bobbin, wherein the first coil is electrically connected to the capacitor via the first terminal.

19. A manufacturing method for an antenna device, comprising:

classifying a plurality of capacitors of the same type used for manufacture of an antenna device into one of two ranks and three ranks in accordance with capacitances of the plurality of capacitors;

arranging a plurality of rod-like cores in series in an axial direction, the plurality of rod-like cores including first and second rod-like cores that are arranged directly adjacent to each other via a gap;

forming a first coil by winding a conductive wire around part of the plurality of rod-like cores, a number of the windings being set according to the classified capacitor that is electrically connected to the first coil, wherein a first end surface of the first rod-like core directly faces a second end surface of the second rod-like core via the cap, and at least one of the first end surface and the second end surface is located on an inner peripheral side of the first coil and a length of the first coil in the axial direction is shorter than each of the first, and second rod-like cores in the axial direction.

20. A manufacturing method for an antenna device, comprising:

arranging a plurality of rod-like cores in series in an axial direction, the plurality of rod-like cores having first and second rod-like cores that are arranged directly adjacent to each other via a gap; and forming a first coil by winding a conductive wire around part of the plurality of rod-like cores, a number of the windings of the conductive wire being always set to a constant value regardless of a capacitance of a capacitor that is electrically connected to the first coil, wherein a first end surface of the first rod-like core directly faces a second end surface of the second rod-like core via the gap, and at least one of the first end surface and the second end surface is located on an inner peripheral side of the first coil, and a length of the first coil in the axial direction is shorter than each of the first and second rod-like cores in the axial direction.

* * * * *